United States Patent [19]
Christensson
[11] 4,199,097
[45] Apr. 22, 1980

[54] BLANK FOR CUP-SHAPED CONTAINER OF CARDBOARD OR THE LIKE

[75] Inventor: Od W. Christensson, Järfälla, Sweden
[73] Assignee: Esseltepac Aktiebolag, Järfälla, Sweden

[21] Appl. No.: 954,075
[22] Filed: Oct. 24, 1978
[30] Foreign Application Priority Data
Oct. 25, 1977 [SE] Sweden ..... 7711983
[51] Int. Cl.² ..... B65D 5/24; B65D 5/40
[52] U.S. Cl. ..... 229/31 R; 229/35
[58] Field of Search ..... 229/30, 31, 34, 35

[56] References Cited
U.S. PATENT DOCUMENTS

| | | | |
|---|---|---|---|
| 2,617,579 | 11/1952 | Buttery | 229/35 |
| 3,863,830 | 2/1975 | Christensson | 229/31 R X |
| 4,008,848 | 2/1977 | Christensson | 229/31 R |
| 4,014,496 | 3/1977 | Christensson | 229/31 R |
| 4,111,352 | 9/1978 | Jørgensen et al. | 229/31 R |

*Primary Examiner*—Davis T. Moorhead
*Attorney, Agent, or Firm*—Larson, Taylor and Hinds

[57] ABSTRACT

A blank is provided for a cup-shaped container to be fabricated of cardboard or the like. The container is of a type comprising substantially rectangular sides which extend upwardly from a bottom and which include rounded corners of the upper edge thereof and an edge flange which projects obliquely downwardly at an angle along the sides. The blank is formed as an integral unit comprising outwardly extending sides which are intergral with a bottom portion and which include a portion that is at least partially bowed when the blank is formed into the container and forms part of the edge flange of the formed container. The edge flange itself comprises an edge flange strip and a reinforcing strip defined by a pair of fold lines in the sides of the blank. V-shaped notches are provided in the bowed portion of the blank thereby enabling the reinforcing strip to extend along a straight line and to be attached to the edge flange strip in planar relationship, thereby providing a double folded edge flange which is folded outwardly and downwardly simultaneously with the sides of the blank being folded upwardly from the bottom portion.

4 Claims, 8 Drawing Figures

BLANK FOR CUP-SHAPED CONTAINER OF CARDBOARD OR THE LIKE

FIELD OF THE INVENTION

This invention relates to an improved blank for cup-shaped containers fabricated of cardboard and the like.

BACKGROUND OF THE INVENTION

The present invention relates to a blank for a cup shaped container fabricated of cardboard material and of the type which comprises a bottom of substantially rectangular form, sides which extend upwardly up from the said bottom and which have rounded corners at the upper edge and an edge flange projecting obliquely downwardly from the said upper edge and extending continuously around the entire upper edge of the container. In a prior art container of this type the edge flange extending obliquely downwards from the upper edge of the container provides stabilizing of the said upper edge. Where the container is used in combination with a reclosable lid the upper edge, and the associated edge flange is subjected to mechanical wear and pressure forces thus in order to make the upper edge sufficiently strong to stand such wear and such mechanical stresses the container ought to be manufactured from a relatively strong cardboard material. In order to reduce the costs for the container it is however desired to use as thin and cheap cardboard material as possible, but it thereby may happen that the upper edge and the edge flange break especially at the long sides of the container which are most subjected to stresses of this type, whereby the long sides are bent in at the point where broken.

The manufacture of a container of this type involves special problems. In order to obtain a container having rounded corners at the upper edge the blank of the container must have a bowed or curved shape at the places corresponding to such round corners. Depending on the said bow shape the edge flange must be bent down at the same time as the container sides are folded up from the container bottom and at the same time the sides are bent to the rounded shape. If the number of material layers is increased at the edge flange and no other modifications are made of the container blank, the edge flange cannot be bent down as mentioned and instead the edge flange has to be bowed in a special operation which does not allow an even and continuous rounding of the corners of the container.

SUMMARY OF THE INVENTION

The object of the invention therefore is to solve the problem of providing the container of the above mentioned kind having upwardly extending sides and rounded corners at the upper edge and an edge flange extending at an angle obliquely downwards along the sides, in which the edge flange is reinforced by at least one additional layer of cardboard material. More particularly the invention relates to a blank for such container formed as a plain punched integral unit in which the edge flange is formed as an outer strip having a bowed shape, at the places corresponding to the rounded corners of the container and which a reinforcing strip which is integral with the edge flange is provided outside the edge flange. According to the invention several V-shaped notches or cuts are provided in the reinforcing strip at or adjacent the bowed shape portions of the edge flange, those notches divide the reinforcing strip into several parts which, when forming the blank into a container, can be folded along straight lines and be attached to the edge flange before the container sides and the edge flange are bent to form a container as mentioned above.

Further characteristics of the invention will be evident from the following detailed specification in which reference will be made to the accompanying drawings.

DESCRIPTION OF THE PREFERRED EMBODIMENTS

Figure 1:
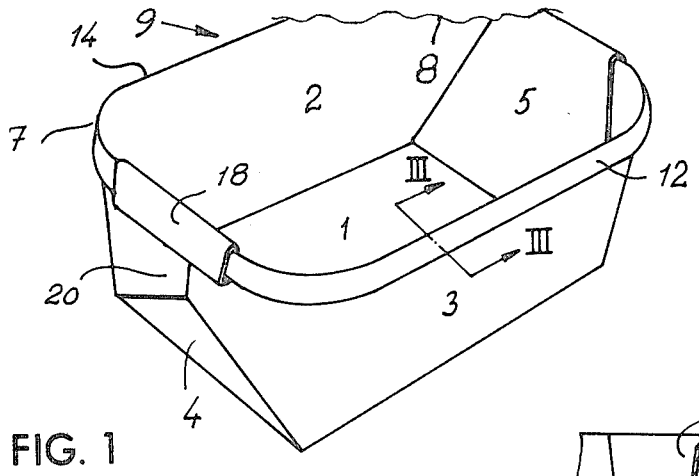
FIG. 1 is a perspective view of a container according to the invention having sharp bottom corners.

The blank for the container shown in FIG. 1 comprises a bottom portion 1 of rectangular form and two opposite side pieces 2, 3 which are integral with the bottom portion and which are longer than the side of the bottom with which they are integral. The blank comprises two additional opposite side pieces 4, 5 which are at most as long as the side of the bottom with which they are integral. Between the side pieces there are substantially triangular connection portions 6 which make it possible to provide a fluid tight bowl-like container in that the connection portions are folded in between the side pieces 4, 5 and the ends of the side pieces 2, 3 when the blank is folded to container form.

The blank is intended to be used in making a container the side pieces of which diverge from the bottom portion and which have rounded corners at the upper edge. For this purpose each side piece 2 and 3 has a bow formed portion 7, 8 at the outer edge. Between the bow formed portions 7 and 8 there is a straight portion 9 and on each side of the bow formed portions there is likewise a straight portion 10 and 11 respectively. In order to provide a stabilizing of the upper edge of the container the blank is formed with an edge flange strip 12 having the same curved outer form as the sides 2 and 3, and in order to provide additional reinforcement of the edge flange 12 the blank is formed with a reinforcing strip 13 extending outside the edge flange 12 and having the same form as the edge flange 12.

The manufacture of a container from the above described blank involves some problems since the edge flange strip 12 is curved. Therefore the edge flange strip 12 cannot be fold to the container sides 2, 3 along a straight line before the container sides are folded up and the container is given its final form. On the contrary the edge flange strips 12 have to be folded outwardly and downwardly at the same time as the container sides 2 and 3 are folded up from the bottom portion 1 and at the same time as the sides are bowed at the bow formed portions 7, 8 to give the intended rounded form of the corners. The object of the reinforcing strip 13 is to provide such reinforcing and because of the double folded material at the edge flange it is possible to use a thinner and cheaper cardboard material for the container than what would otherwise been possible thus, the container can withstand the stresses which appear when a reclosable lid is put on and taken off respectively. However the reinforcing strip 13 cannot be bowed in the same way as the edge flange 12, and according to the invention a number of V-shaped notches or cut out portions 15 therefore are provided in the reinforcing strip at the bow formed portions 7 and 8. In the illustrated embodiments there are three perforations 15 between which there are two truncated conical ears 16. These ears can be readily folded and attached to the intended underside of the edge flange. Correspondingly the plain portions 9, 10, 11 of the reinforcing strip 13 between and adjacent the bow formed portions are folded over and are attached to the intended underside of the edge flange 12. The connection of the edge flange 12 and the reinforcing strip 13 is preferably made by means of glue in a glue and press operation before the blank is assembled and is given its final cup form.

The edge flange strip 12 and the reinforcing strip 13 have such total lengths as to extend unbroken around the entire container strips 12 and 13 are connected edge to edge substantially at the center of the container sides 4 and 5. In order to keep the edge flange in this position the side pieces 4 and 5 are formed with two successive joining strips 18, 19 of which the inner joining strip 18 is folded over in upper edge 14 of the container and contacts the outside of the edge flange 12 whereas the outer joining strip 19 is folded in to the inner side of the edge flange 12.

Figure 2:
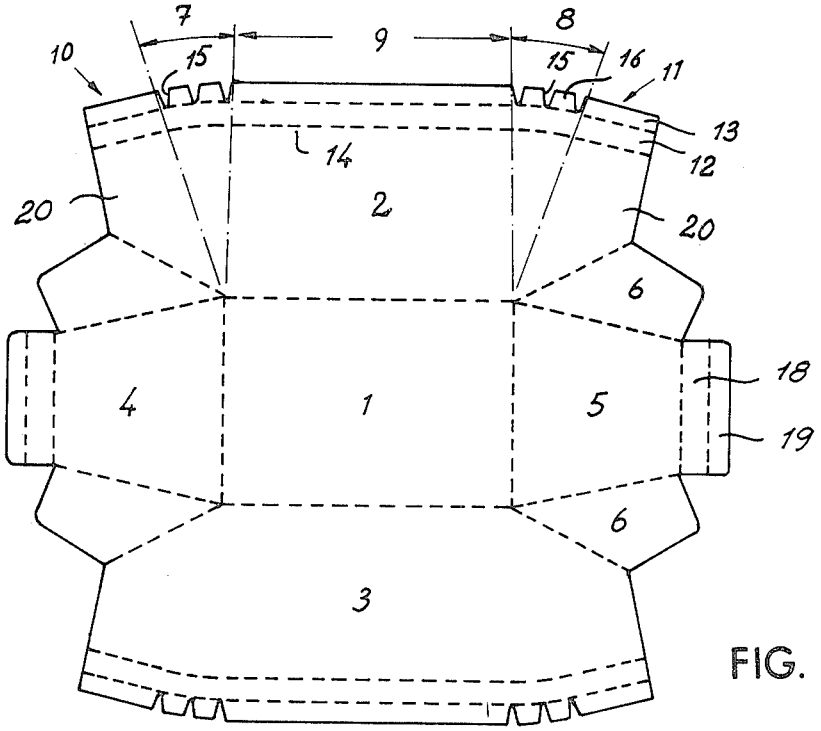
FIG. 2 shows a blank according to the invention for the container shown in FIG. 1.

As mentioned above the constructing and joining together of the blank illustrated in FIG. 2 is carried out such that the short sides 4 and 5 are folded up from the bottom portion 1, and just following the start of bending the short sides 4 and 5 upwards, the long sides 2 and 3 are folded up at the same time as the long sides are successively given a rounded form at the bow formed portions 7 and 8 and at the same time as the edge flange 12 is fold outwardly and downwardly. Thereby the connection portions 6 are folded in between the short sides 4 and 5 and the end portions 20 of the long sides 2 and 3. Preferably the sides 4 and 5, the connection portions 6 and the ends 20 of the long sides are connected by being glued, pasted or welded. Finally the joining strips 18 and 19 of the short sides are folded outwardly and downwardly and are attached to the inner sides of the edge flange 12.

Figure 3:
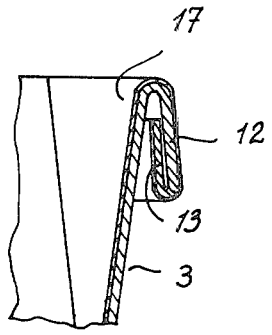
FIG. 3 is a cross section along line III—III of FIG. 1.
Figure 4:
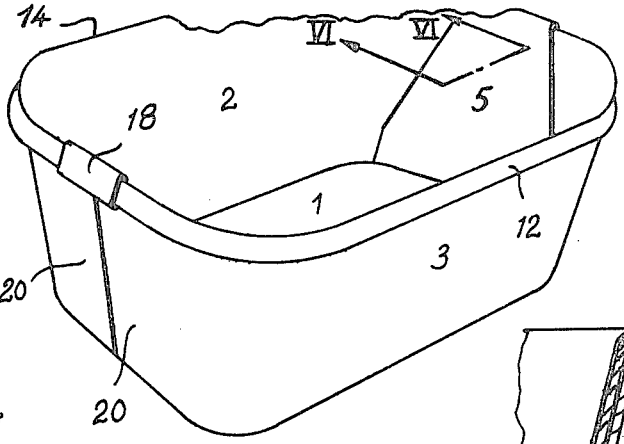
FIG. 4 is similar to FIG. 1 and shows a container according to the invention having rounded bottom corners.
Figure 6:
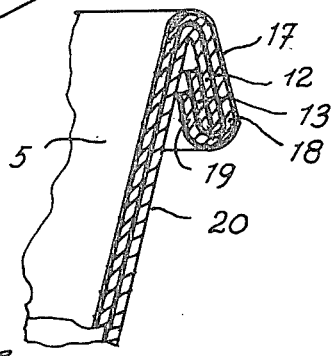
FIG. 6 is a cross section along line VI—VI of FIG. 4.
Figure 5:
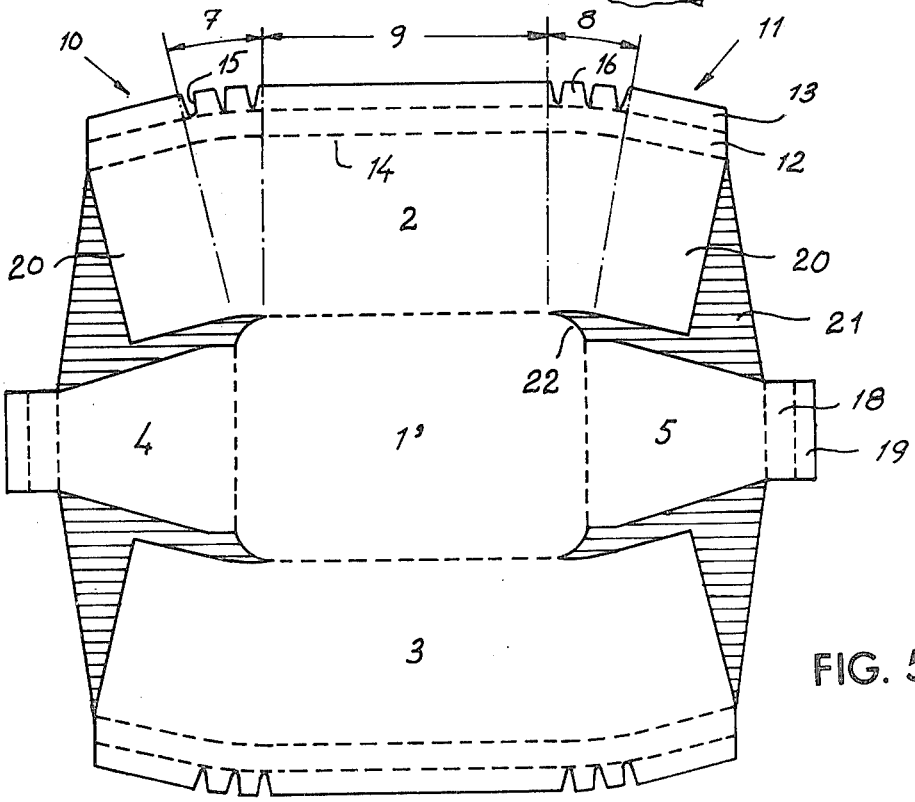
FIG. 5 shows a blank for the container of FIG. 4.

The embodiment of the invention illustrated in connection with FIGS. 4–6 generally corresponds to the embodiment according to FIGS. 1–3, but in the former embodiment the blank is formed with rounded corners also at the bottom. If there is no need that the container is fluid tight it can be made solely of cardboard which may be covered or laminated with some material like plastic, but if the container has to be fluid tight the blank is preferably connected to a lining blank 21 of a sealing material. In order to get the rounded bottom corners the bottom portion 1' of the blank is formed with rounded corners 22, and in this case the connection portions 6 are left out.

The assemblies and the joining of the blank to a cup formed container basically follows that of the embodiment described above.

Figure 7:
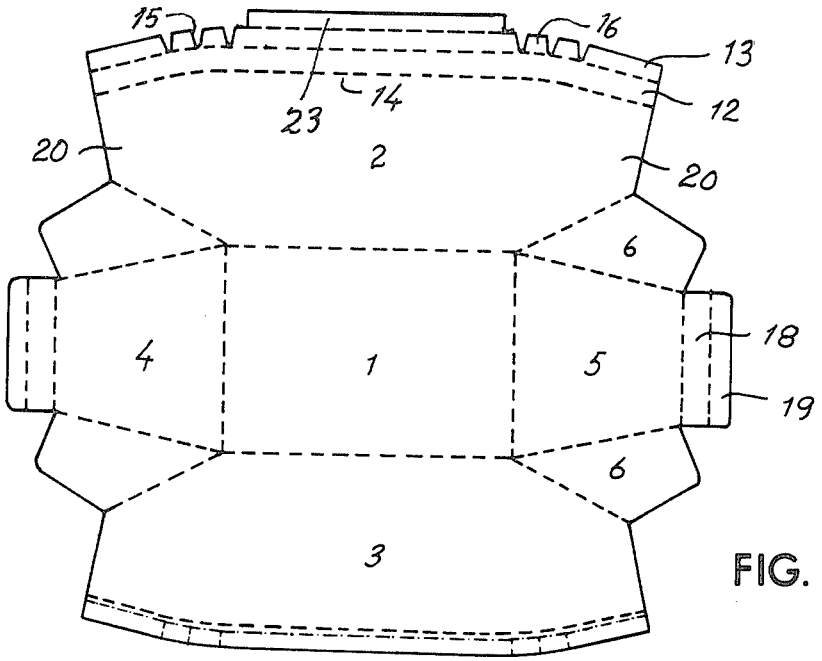
FIG. 7 shows a modified blank for a container of the type shown in FIG. 1.

In FIG. 7 is illustrated an alternative embodiment of the blank according to the invention in which an additional reinforcing strip 23 is provided outside the reinforcing strip 13 at the intermediate straight portion of the long sides and which provides a three fold layer of material at the long straight portion of the edge flange which has the strongest tendency of being broken. In the lower half of FIG. 7 there is shown how the outer reinforcing strip 23 is folded in and thereafter the reinforcing strip 13 is folded over and is attached by being glued to the edge flange strip 12 (phantom lines).

Figure 8:
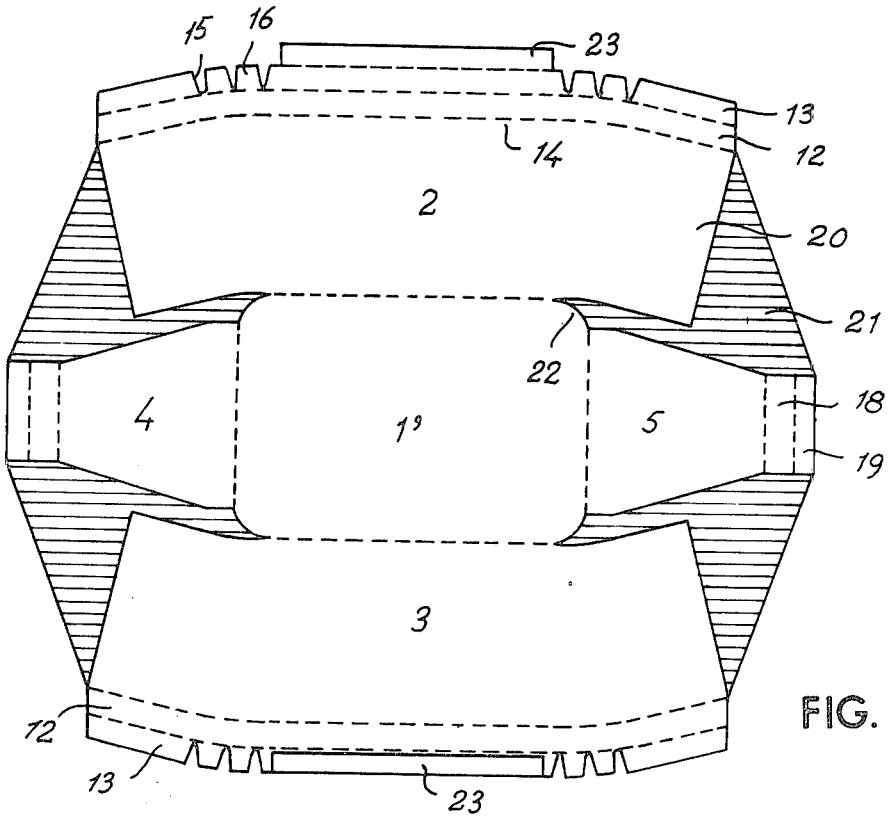
FIG. 8 illustrates in the same way a modified blank for a container of the type shown in FIG. 4.

In FIG. 8 there is illustrated how an outer reinforcing strip 23 is provided outside the reinforcing strip 13, and in the lower half of the figure is shown an introductory phase of making the container ready in which the outer reinforcing strip 23 is folded over and is attached to the underside of the container blank.

When glueing the reinforcing strip 13 to the edge flange strip 12 the glue pressure is preferably provided somewhat inside the outer edge which has as an effect that a somewhat thickened portion is obtained outside the pressure surface what provides stabilizing of the outer edge of the edge flange and an even and aesthetically pleasing ending of the edge flange.

It is to be understood that the embodiments described above and shown in the drawings are only illustrative examples and that all kinds of different modifications may be presented within the scope of the appended claims.

What we claim is:

1. A blank for a cup-shaped container fabricated of cardboard or the like and comprising a bottom of substantially rectangular shape, a plurality of sides projecting upwardly from side edges of the bottom and having rounded corners at the upper edge thereof and an edge flange projecting obliquely downwardly at an angle along said sides from the upper edge and extending continuously around the entire upper edge, said blank being formed as an integral unit comprising a bottom portion and sides which are integral with said bottom portion, each of two opposite sides of said blank being longer than the lateral edge of the bottom portion with which said two sides are integral, said two sides including a portion which is partially bowed when the blank is formed into the container so as to provide the rounded corners of the container and which is an integral part of the edge flange of the formed container, the total length of the edge flange corresponding to the periphery of the container at the upper edge thereof, said edge flange of said blank comprising a combination of an edge flange strip and reinforcing strip which extend parallel to each other and are defined relative to the corresponding sides of the blank by parallel lines in said corresponding sides, a portion of each said reinforcing strip, formed by the bowed portion of the sides which provide the rounded corners of the containers, having at least two V-shaped notches therein enabling the reinforcing strip to extend along a straight line and be attached to the edge flange strip in planar relationship to provide a double folded edge flange which is folded outwardly and downwardly at the same time as the associated sides of the blank are similarly bowed to provide the rounded shaped at the upper edge of the container when the container is formed.

2. Container blank according to claim 1, wherein the reinforcing strips, at each bowed portion thereof corresponding to a rounded corner of the container, has three V-shaped notches therein and wherein the reinforcing strip is folded and attached by glueing to the underside ot the edge flange.

3. Container blank according to claim 2, wherein in the glueing of the reinforcing strip to the edge flange strip is provided by a press force which is applied inwardly of the folded edge thereof so that a narrow thickened rib of material is formed at the outer edge of the edge flange.

4. Container blank according to any one of claims 1 to 3, wherein a further reinforcing strip is provided outside the first mentioned reinforcing strip at least one straight portion thereof, said reinforcing strip being folded in and attached to the first mentioned reinforcing strip, and the first mentioned reinforcing strip, together with the further reinforcing strip, being folded in and attached to edge flange strip so that a triple folded layer of material is provided at the said straight portion of the edge flange.

* * * * *